United States Patent [19]

Frykhult

[11] 4,175,036

[45] Nov. 20, 1979

[54] HYDROCYCLONE SEPARATOR

[75] Inventor: Rune H. Frykhult, Huddinge, Sweden

[73] Assignee: AB Celleco, Stockholm, Sweden

[21] Appl. No.: 923,207

[22] Filed: Jul. 10, 1978

[30] Foreign Application Priority Data

Jul. 18, 1977 [SE] Sweden ..... 7708270

[51] Int. Cl.[2] ..... B04C 5/04

[52] U.S. Cl. ..... 209/211; 210/512 R

[58] Field of Search ..... 209/211, 144; 210/512 R, 512 M; 55/426, 459 D, 459 R

[56] References Cited

U.S. PATENT DOCUMENTS

| | | | |
|---|---|---|---|
| 911,258 | 2/1909 | Neumann | 55/426 |
| 2,744,338 | 5/1956 | Rothe | 210/512 R X |
| 3,358,833 | 12/1967 | Cantrell | 209/211 |
| 3,385,437 | 5/1968 | Woodruff | 209/211 |

*Primary Examiner*—Ralph J. Hill

*Attorney, Agent, or Firm*—Cyrus S. Hapgood

[57] ABSTRACT

A hydrocyclone chamber includes a cylindrical part having a tangential inlet and a central outlet for a separated fraction of the incoming mixture, the chamber also including a conical part leading to a second outlet for another fraction of the mixture. A guide bar extends circumferentially along the wall of the cylindrical part at least to the inlet orifice and is bent and inclined to give the mixture flowing from said inlet a component of movement directed radially inward and a component of movement directed axially toward said conical part of the chamber.

4 Claims, 6 Drawing Figures

HYDROCYCLONE SEPARATOR

Figure 1:
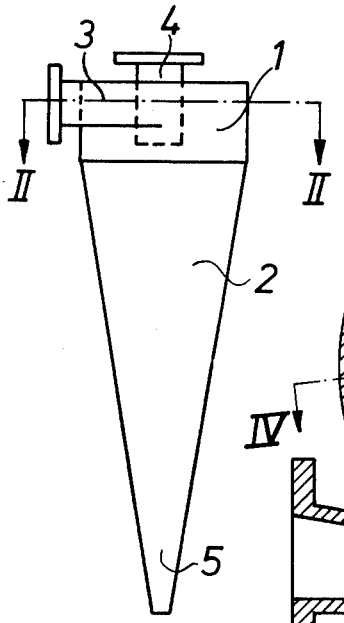

This invention relates to a hydrocyclone separator for the separation of mixtures into two fractions, with a separation chamber comprising one circular cylindrical part provided with at least one tangential inlet for the incoming mixture and one central first outlet for one of the fractions, and also comprising one conical part leading into a second outlet for the other fraction, at least one guide bar being provided in the circular cylindrical part of the separation chamber.

Hydrocyclone separators have many uses, especially in the cellulose industry for the purification of cellulose fiber suspensions. The impurities consist substantially of sand, bark particles and incompletely digested fibers, so-called shive. It is desirable to separate in the hydrocyclone separators, as efficently as possible, the fibers on one hand and the impurities on the other. This means that as large a part as possible of the fibers fed to the hydrocyclone separator must leave it in a flow (so-called "accept") through the central, first outlet and that as large a part as possible of the impurities must be discharged in a flow (so-called "reject") through the other outlet. The purification rate, expressed in %, is defined as:

$$\eta = \frac{\text{amount impurities fed} - \text{amount impurities in accept}}{\text{amount impurities fed}} \times 100$$

The content of shive in the pulp suspensions has proved to entail especially great difficulties when a high degree of purification has been sought. Thus, it has been necessary to leave a relatively large part of fibers discharging with the reject flow, in order to achieve a sufficiently low content of shive in the accept flow. In spite of this, it has proved to be difficult or impossible to achieve a desirable purification degree.

In the hydrocyclone field, it has long been attempted to design hydrocyclones with a better purification effect. For example, different types of guide bars provided in the separation chamber have been tested. Heretofore, however, these guide bars have proved to have a limited effect or even a disadvantageous effect. This is the case, for example, for shive in fiber pulp with guide bars arranged in the circular cylindrical part in such a way that they give the tangetially incoming flow only an axial component of movement, directed towards the conical part of the separation chamber.

According to the present invention, the problem of achieving a higher degree of purification (especially regarding shive in fiber pulp in a hydrocyclone separator of the type first mentioned) is solved by providing a guide bar extending from the wall of the separation chamber circumferentially along said wall at least to the orifice of the inlet in the separation chamber, the guide bar being bent and inclined in such a way that the flow of mixture fed through the inlet is given a component of movement directed radially inwards and a component of movement directed axially towards the conical part of the separation chamber.

In one preferred embodiment, the axial elongation of the guide bar at the orifice of the inlet is at least as long as that of said orifice.

Embodiments are also possible where the guide bar extends downwards to the conical part of the separation chamber. This is especially true if the circular cylindrical part of the separation chamber is relatively short.

Figure 2:
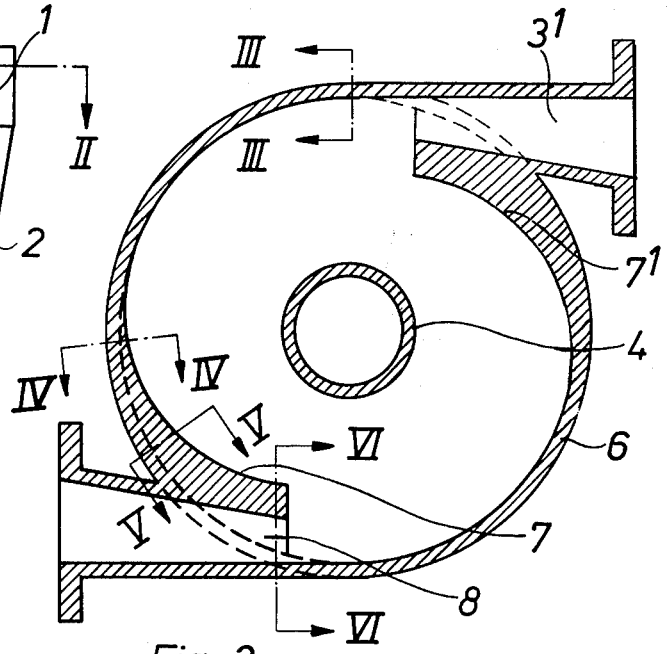

The invention will now be described more in detail with reference to the accompanying drawing, in which FIG. 1 is an elevational view of a hydrocyclone separator according to the invention;

FIG. 2 is a horizontal sectional view taken along line II—II in FIG.1; and FIGS. 3–6 are sectional views taken along lines III—III, IV—IV, V—V and VI—VI, respectively, in FIG. 2.

Figure 3:
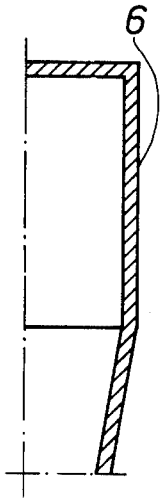
Figure 4:
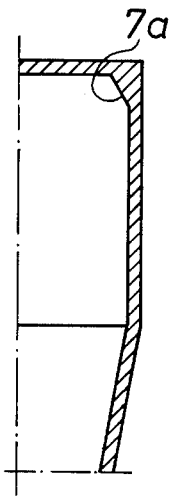
Figure 5:
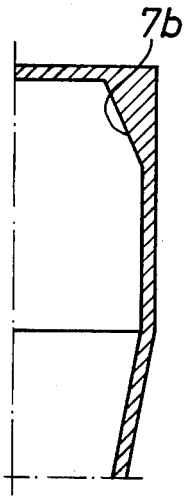
Figure 6:
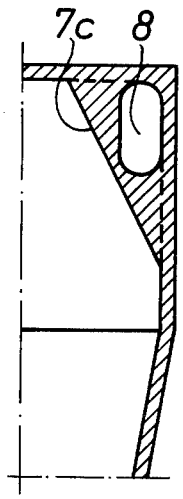

The hydrocyclone separator shown in FIG. 1 comprises a separation chamber having a circular cylindrical part 1 and a conical part 2. The cylindrical part 1 has a tangential inlet 3, and a central outlet 4, and an outlet 5 is provided in the apex of the conical part. In FIG. 2, 6 denotes the wall of the circular cylindrical part of the separation chamber, 3' is a second tangential inlet, each inlet having an orifice 8, and two guide bars are shown at 7 and 7'. Part of the separation chamber where no guide bar is provided is shown in FIG. 3. FIGS. 4–6 show parts 7*a*, 7*b* and 7*c* of guide bar 7, while the orifice of inlet 3 is shown at 8. It will be apparent, therefore, that as guide bar 7 extends circumferentially toward inlet orifice 8, the bar not only approaches the symmetry axis of the cyclone but also acquires a greater axial dimension (i.e., a greater dimension vertically as shown).

The orifice 8 of inlet 3 is shown here with an oval cross section. It may, however, have any cross section, such as trapezodial, which means certain advantages regarding the prevention of cavitation and formation of deposits.

It is obvious that guide bar 7 may be a plane surface having a single bend and is arranged extending from the wall 6 of the separation chamber, inclined inwards toward the symmetry axis of the hydrocyclone separator. Guide bar 7, as shown, extends circumferentially to the place where inlet 3 enters the separation chamber.

The invention is applicable to hydrocyclone separators with any number of tangential inlets, but generally the use of no more than four inlets is advantageous.

The following example may be mentioned to show the improvement of the purification effect, in the purification of fiber pulp from shive, which can be obtained with guide bars in hydrocyclone separators according to the invention:

Tests were performed with the purification of 0.6% by weight fiber pulp suspension containing 2% shive calculated on the fiber weight. In the tests, hydrocyclone separators of a conventional type and those provided with guide bars according to the invention were used. The capacity (i.e., the volume of pulp suspension fed to the hydrocyclone separator per unit of time) was identical in tests performed at the same pressure drop across the hydrocyclone separator. The purification effect for shive, $\eta$, was determined.

| | Pressure (meters water column) | | |
|---|---|---|---|
| | 10 m | 15 m | 20 m |
| Conventional hydrocyclone separator | $\eta$ = 61% | $\eta$ = 72% | $\eta$ = 80% |
| Hydrocyclone according to the invention | $\eta$ = 72% | $\eta$ = 80% | $\eta$ = 85% |

It is obvious that the purification effect is improved by 5–11 absolute percents. Indirectly it can also be seen that the pressure drop may be reduced, the purification effect being maintained on the same level, which means that the pumping effect may be reduced. This is an important advantage in view of the ever rising energy costs.

I claim:

1. In a hydrocyclone separator for separating a mixture into two fractions, the combination of means forming a separation chamber having an axis and a surrounding wall, said chamber including a circular cylindrical part provided with at least one tangential inlet for the incoming mixture and with a central first outlet for one of the fractions, said inlet having an orifice in the chamber, said chamber also including a conical part and a second outlet for the other fraction and to which said conical part leads, and a guide bar located in said cylindrical part of the separation chamber, said bar extending from said wall circumferentially along said wall at least to said orifice and being bent and inclined to give the flow of mixture fed through said inlet a component of movement directed radially inward and a component of movement directed axially toward said conical part of the chamber.

2. The combination of claim 1, in which the axial dimension of the guide bar at said orifice is at least as great as the axial dimension of said orifice.

3. The combination of claim 1, in which said guide bar, as it extends circumferentially toward said orifice, approaches said axis and acquires a greater axial dimension.

4. The combination of claim 1, in which said tangential inlet causes the incoming mixture to rotate in one direction about said axis in said circular cylindrical part of the separation chamber, said bar extending circumferentially along said wall in said one direction at least to said orifice.

* * * * *